US012805563B2

(12) United States Patent
Field

(10) Patent No.: US 12,805,563 B2
(45) Date of Patent: Nov. 24, 2026

(54) DEVICE FOR EXTINGUISHING AND RETAINING SMOKABLE MATERIALS AND METHODS OF USE

(71) Applicant: Erin M Field, Springfield, MA (US)

(72) Inventor: Erin M Field, Springfield, MA (US)

( * ) Notice: Subject to any disclaimer, the term of this patent is extended or adjusted under 35 U.S.C. 154(b) by 932 days.

(21) Appl. No.: 18/076,094

(22) Filed: Dec. 6, 2022

(65) Prior Publication Data

US 2024/0148056 A1 May 9, 2024

Related U.S. Application Data

(60) Provisional application No. 63/424,078, filed on Nov. 9, 2022.

(51) Int. Cl.

| | |
|---|---|
| ***A24F 19/14*** | (2006.01) |
| ***A24F 13/18*** | (2006.01) |
| ***A24F 19/00*** | (2006.01) |

(52) U.S. Cl.

CPC ..... *A24F 19/14* (2013.01); *A24F 13/18* (2013.01); *A24F 19/0035* (2013.01)

(58) Field of Classification Search

None

See application file for complete search history.

(56) References Cited

U.S. PATENT DOCUMENTS 1,911,262 A * 5/1933 Athon ..... A24F 19/14 131/237

FOREIGN PATENT DOCUMENTS

WO WO-8802224 A1 * 4/1988 ..... A24F 19/00

OTHER PUBLICATIONS

WO 8802224 A1 text (Year: 1988).*

* cited by examiner

*Primary Examiner* — Michael J Felton

(74) *Attorney, Agent, or Firm* — Armory Legal Group PLLC; Hubert W. Pfabe

(57) ABSTRACT

A device and related methods of use may be used to aid in snuffing out, suffocating, extinguishing, or otherwise putting out a burning or smoking item, such as a cigarette or a cigar. The device may include a feature or area for receiving ash or other byproducts of burning, such as an ashtray, and may include a hood-like area, opening, or feature. Cylindrical, substantially cylindrical, or otherwise elongated items may be placed within a receiving area, wherein burning, smoking, or displacement may deprive the item of oxygen and extinguish the item. Quality of items, as retained for later use, may be improved over other means of extinguishing. The device may be made of a variety of materials, such as glass, resin, metal, clay, or hybrid materials, and may include a range of coloring and designs.

18 Claims, 9 Drawing Sheets

DEVICE FOR EXTINGUISHING AND RETAINING SMOKABLE MATERIALS AND METHODS OF USE

This application claims the priority of U.S. Provisional Patent Application No. 63/424,078 filed on Nov. 9, 2022, the disclosure of which is incorporated herein in its entirety.

BACKGROUND

The present disclosure relates generally to a device for extinguishing smokable or flammable materials and items, as well as retaining such items, material, or their byproducts, and related methods of use. More particularly, the present disclosure relates to a reusable device which may be used to suffocate or otherwise aid in putting out a burning item, such as a cigarette, cigar, cigarillo, or other similar smoking implement, as well as retaining the item and optionally having a location for ash or other byproducts from the item or similar items.

Smokable or otherwise flammable or partially flammable or combustible materials may be formed into cylindrical, substantially cylindrical, or otherwise elongated shapes. These may be commercially available items, such as cigarettes, cigars, or cigarillos, or may be individually made or made for personal use, such as with items that are commonly known as "joints". A variety of wrapping materials, including paper, tobacco leaves, other types of leave, paper, or similar items, or other flammable materials, may be used. Additionally, a variety of materials may be wrapped or rolled in the item, including, but not limited to, tobacco as well as, separately or jointly, materials of a medicinal or pharmacological nature. This disclosure is intended to include and apply to all such combinations, which, for the sake of simplicity, are referred to as "cigarettes", "cigars", or "joints", in this disclosure, though this disclosure should be understood to apply to all similar and related items.

When smoking a cigar or cigarette, one may wish to put it down or to put it out so as to be able to enjoy it later, whether such time be brief moments later or a more substantial amount of time. In such instances, it is desirable to be able to expedite having the cigar or cigarette become extinguished, so that one does not burn through it while not using or enjoying it. Additionally, one does not wish the process of extinguishing the cigar or cigarette to negatively affect the future flavor, when re-lit, of the cigar or cigarette or to waste an excessive amount of the yet-to-be-smoked cigar or cigarette. The traditional means of accomplishing this are to break or "flick" off the burning end, thus losing a portion of the cigar or cigarette, or to "snub" it out, pressing it down to remove any burning portion or to otherwise extinguish the portion, which can damage the remaining portion of the cigar or cigarette while also potentially leading to a burned or otherwise undesirable flavor to the cigar or cigarette when later relit.

Attempts have been made to offer tubes or other disposable means for storing cigars or cigarettes, though such means are costly when needing to be repeatedly purchased and are also inconvenient to use and keep around for use. Such means do not offer receptacles or storage for ash, waste, or byproducts, and also often require that the cigar or cigarette be already at least partially extinguished. Furthermore, such means are not aesthetically pleasing, and thus do not present consumers with options which a consumer may use in a public setting or in social situations, such as where the image of cigar or cigarette use, extinguishing, and relighting can be an important factor.

Current devices and methods of use for being able to put out a cigar or cigarette, such as extinguishing it, while preserving it for later use, are not effective or convenient. Current devices are also not aesthetically pleasing for social situations or degrade the use of the cigar or cigarette prior to later re-use. Current devices and methods of use do not provide a pleasing and effective means of extinguishing a cigar or cigarette while preserving it for later use. Current devices and methods of use also do not provide a receptacle for ash or other byproducts of cigars or cigarettes or for temporary storage of a cigar or cigarette.

SUMMARY

The present disclosure relates generally to a device for extinguishing smokable or flammable materials and items, as well as retaining such items, material, or their byproducts, and related methods of use. More particularly, the present disclosure relates to a reusable device which may be used to suffocate, extinguish, or otherwise aid in putting out a burning item, such as a cigarette, cigar, cigarillo, or other similar smoking implement, as well as retaining the item and optionally having a location for ash or other byproducts from the item, or similar items herein described, implied, known in the art, or reasonably extrapolated from this disclosure.

Smokable or otherwise flammable or partially flammable or combustible materials may be formed into cylindrical, substantially cylindrical, or otherwise elongated shapes. These may be commercially available items, such as cigarettes, cigars, or cigarillos, or may be individually made, or may be made for individual or personal use, such as what are commonly known as "joints". A variety of wrapping materials, including paper or tobacco leaves, among others, may be used. Additionally, a variety of materials may be wrapped or rolled in the item, including, but not limited to, tobacco, medicinal materials, or substances with pharmacological effects, whether separately or jointly. This disclosure is intended to include and apply to all such combinations, which, for the sake of simplicity, are referred to as "cigarettes", "cigars", or "joints", in this disclosure, though this disclosure should be understood to apply to all similar and related items.

A device for extinguishing and retaining cigars or cigarettes is disclosed, as well as related methods of use. The device may be made in a range of sizes and shapes, including sizes which may fit in a user's pocket and be easily transportable. Shapes, designs, patterns, materials, and colors of the device may be used which may be aesthetically pleasing to users. The device is intended to be able to extinguish a cigar or cigarette quickly, thus preserving the cigar or cigarette maximally for later use while also minimizing the amount of smoke in the air or near the device. As many cigars or cigarettes are prized or otherwise desirable based on flavors of the smoked materials, including at times very subtle or intricate flavors, which may be easily affected by the process of extinguishing the cigar or cigarette, it is desirable to have a device which can put out a cigar or cigarette without creating a burnt taste, or which may otherwise minimally affect the flavour of the cigar or cigarette.

A device is disclosed which includes a feature which defines an at least partial opening configured to receive at least a portion of a cigar or cigarette. The opening may be closed at one end, thus creating an area to receive smoke from a burning or otherwise smoking cigar or cigarette, or to minimize oxygen retention, enabling the cigar or cigarette to be extinguished due to a lack of oxygen after a period of time, such as shortly after insertion of a burning end of a cigar or cigarette into the opening. In some embodiments, the opening may be substantially cylindrical or otherwise comprise an elongated at least partially open area. In other embodiments, the device may include a hood configured to retain smoke or to limit oxygen being supplied to a burning or smoldering cigar or cigarette, wherein the opening may be less cylindrical in natural but rather provide a partially enclosed volume which, upon insertion or appropriate location of a cigar or cigarette, may restrict or hinder flow of air to the burning portion of the cigar or cigarette.

The device may include a tray or other feature for receiving the cigar or cigarette, and the device may also optionally include an ashtray or other feature configured to receive ash or other byproducts from smoking a cigar or cigarette. The device may optionally include an indent or other feature on an optional rim, such as to aid in retaining a cigar or cigarette when not in use by a user.

In some embodiments, the hood or opening may be unitary with the ashtray. In some embodiments, there may be no need for a cover or separate removable component to cover the ashtray or to limit oxygen being supplied to a cigar or cigarette which is intended to be extinguished.

During one method of use, a user may use the ashtray feature of the device to receive ash or other byproducts of a cigar or cigarette. In a method of use, when a user wishes to extinguish or otherwise preserve a cigar or cigarette, the user may place the cigar or cigarette at least partially within an at least partial opening in the device or at least partially under a hood of the device. In another method of use, a user may place an extinguished or lit cigar or cigarette at least partially within the ashtray or along an optional rim or at least partially in an indent configured to receive and aid in retaining the cigar or cigarette when not in use.

The disclosure relates to a device and method of use, such as through the use of the described invention. The method may include the use of a device which may include one or more of the features or components described herein. Any number of components or features may be used in conjunction with and incorporated into the device described. Various materials, including metals, plastics, glass, epoxy, resin, wood, ceramics, clay, and composites, may be used for the described components and features.

It is to be understood that the above mentioned features and the features yet to be explained hereinafter can be used not only in the respectively mentioned combinations but also in other combinations or alone without departing from the context of the present invention.

BRIEF DESCRIPTION OF THE DRAWINGS

The invention is now disclosed in detail with reference to exemplary embodiments shown in the accompanying drawings, where.

DETAILED DESCRIPTION

Figure 1:
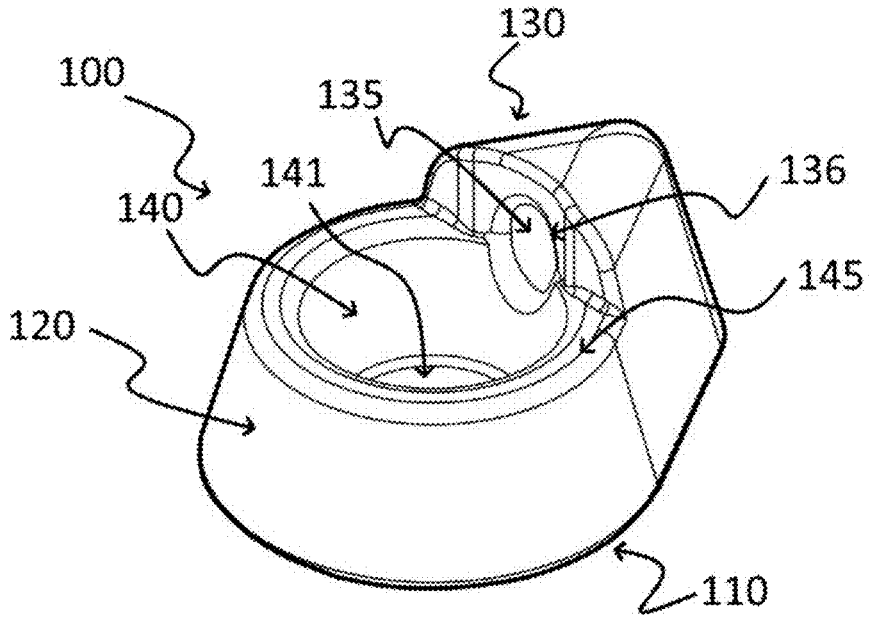
FIG. 1 shows a front top right isometric view of an embodiment of the extinguishing device of the present disclosure.
Figure 2:
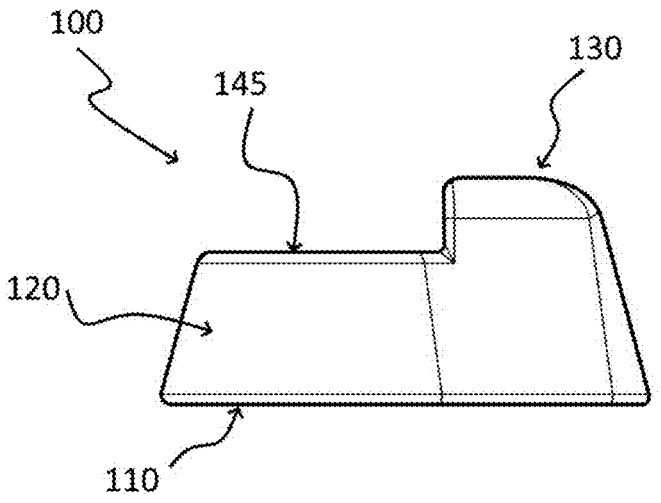
FIG. 2 shows a right side view of the embodiment of the extinguishing device of FIG. 1.
Figure 3:
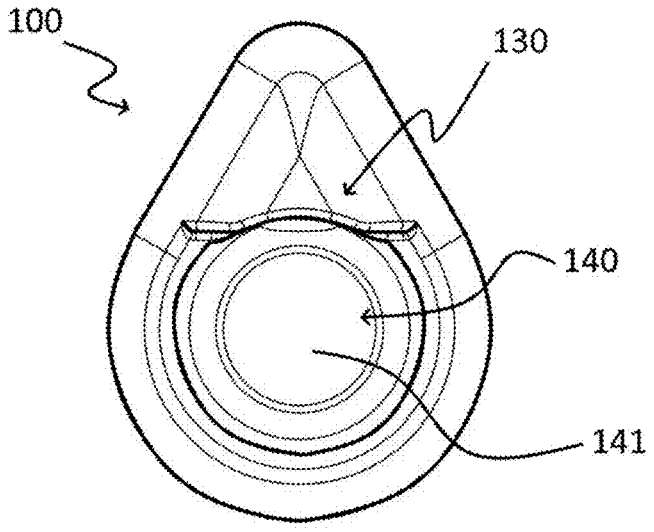
FIG. 3 shows a top view of the embodiment of the extinguishing device of FIG. 1.
Figure 4:
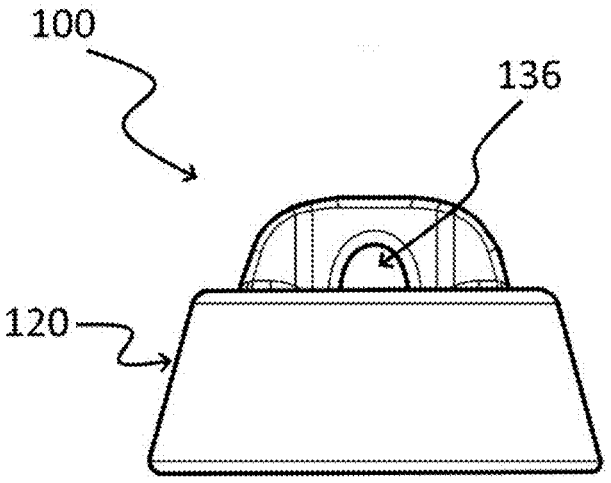
FIG. 4 shows a front view of the embodiment of the extinguishing device of FIG. 1.

Exemplary embodiments of the disclosure are illustrated in the Figures and are explained in the following description in more detail, wherein identical, or similar, reference numbers refer to identical, or similar, or functionally identical or similar components.

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without some specific details. In other instances, well-known features or those previously described are omitted or simplified in order not to obscure the illustrative embodiments.

Various operations may be described as multiple discrete operations, in turn, in a manner that is most helpful in understanding the present invention, however the order of description should not be construed as to imply that these operations are necessarily order dependent. In particular, these operations need not be performed in the order of presentation. In some instances, structures and devices may be shown in block diagram or flow chart form in order to facilitate describing the disclosed subject matter.

An embodiment of a device for extinguishing and optionally retaining smokable materials 100 is shown in FIGS. 1-5. Though the device 100 is described as an ashtray 100 or simply as the device 100 herein for simplicity, it should be understood that the device 100, or embodiments of the device 100, may be used without retaining or providing a receptacle for ash, or a receptacle may be provided without retention of cigars or cigarettes. Embodiments may retain ash or byproducts of combustion, may aid in retention of cigars or cigarettes, may aid in extinguishing burning cigars or cigarettes, or combinations of such features and functionality, without deviating from the scope or intent of this disclosure.

The device 100 may be made through a variety of means known in the art, including, but not limited to, machining, molding, 3d printing or other additive manufacturing, glass blowing, clay molding or sculpting, resin pouring, ceramics, cutting, or other means known in the art. In one embodiment, the device 100 may be made by pouring resin into a mold, such as a silicon mold.

In the embodiment shown in FIGS. 1-5, the device 100 may include a bottom or base 110, and it may include an exterior wall 120. The device 100 may have a base 110 which may be different shapes and also may have different footprints. Though the base 110 is shown as having a substantially teardrop footprint, such as when viewed from above, it should be understood that other shapes may also be used without deviating from the scope or intent of this disclosure, including, but not limited to, circular, rectangular, square, triangular, pentagonal, hexagonal, elliptical, octagonal, and compound or hybrid shapes.

The exterior wall 120 is shown as sloping inwards as it extends upwards and away from the base 110, such as when viewed from the front. It should be understood that, in other embodiments, the exterior wall 120 could be substantially perpendicular to the base 110, could slope outwards, could have prominences, could have recesses, could slope in in some areas and out in other areas, or could have other shapes, features, or profiles without deviating from the scope or intent of this disclosure.

The device 100 may include a hood 130. The hood 130 may be unitary with the base 110, or the hood 130 may be a separate component from the base 110. In the embodiment shown, the device 100 is entirely unitary. The hood 130 may extend above a receptacle feature 140 of the device, may be adjacent to a receptacle feature 140 of the device, or may be located elsewhere on the device 100. The hood 130 may define an at least partially open receiving volume 135, which may be configured to at least partially receive a cigar or cigarette. When at least a burning or smoking portion of a cigar or cigarette is placed at least partially within the receiving volume 135, oxygen may be depleted so as to extinguish the cigar or cigarette.

In the embodiment shown, the receiving volume 135 is substantially cylindrical in side cross-section, configured to approximate or closely match the shape and dimensions of a cigar or cigarette. It should be understood, however, that the receiving volume 135 may be other elongated shapes. Additionally, or alternatively, the receiving volume 135 may be a shape which is not elongated, such as being a wider open volume. The receiving volume 135 may also alternatively be shaped to mimic the shape of the hood 130, such as being an offset cross-sectional shape partially or substantially maintaining the wall thickness of the hood 130. The receiving volume 135 may be any shape or size, configured to receive one or more cigars or cigarettes and configured to aid in extinguishing the one or more cigars or cigarettes by depriving them of oxygen to maintain burning, such as by closely fitting around the shape of the cigar or cigarette or by filling with and at least partially retaining smoke instead of or displacing oxygen.

Figure 5:
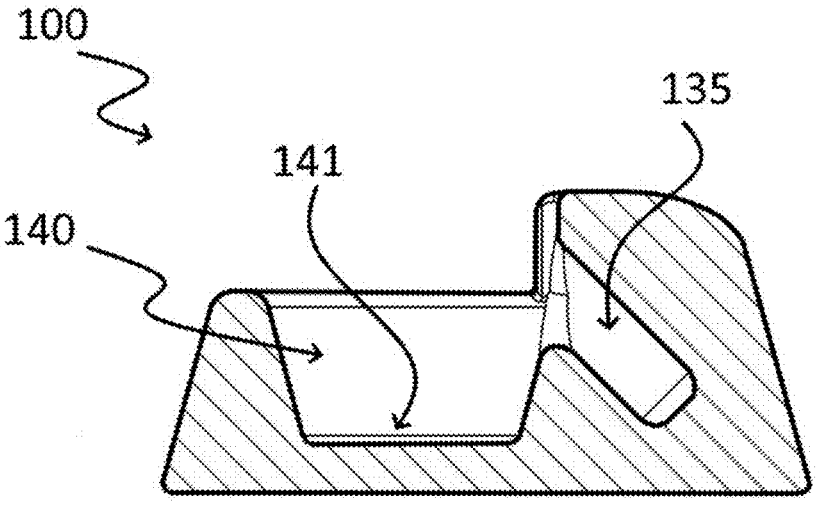
FIG. 5 shows a right side cross-sectional view of the embodiment of the extinguishing device of FIG. 1.

As shown in FIG. 5, the receiving volume 135 may optionally angle downwards, such as towards the base 110 and away from the opening 136 of the receiving volume 135 or away from the receptacle feature 140. It should be understood, however, that the receiving volume 135 may be substantially even or coplanar with the receptacle feature 140, may be angled to a side relative to the receptacle feature 140 or the opening 136, may widen or otherwise change shape cross-sectionally relative to the opening 136, or may angle upward relative to the opening 136 and/or the receptacle feature 140. The receiving volume 135 may also be curved or be shaped in other ways, including compound shapes. Optionally, the receiving volume 135 may also include one or more pockets or capture volumes, which may aid in retaining an initial amount of smoke and then displacing oxygen from the receiving volume 135.

The device 100 may optionally include a receptacle feature 140, which may optionally include or define a rim 145. Though not shown in this embodiment, the rim may optionally include an indent or other retention feature to aid in retention of a cigar or cigarette. The retention feature may be on the rim, or may be located on another surface or feature of the device. The receptacle feature 140, where present, may be an at least partial opening, may be concave, may be substantially flat or planar, or may be otherwise configured to aid in receiving or retaining ash or other byproducts of smoking. Though the receptacle feature 140 is shown as being substantially circular when viewed from above in this embodiment, it should be understood that other shapes, including rectangular, square, triangular, pentagonal, hexagonal, octagonal, elliptical, teardrop, compound or hybrid shapes, as well as others, may be used without deviating from the scope or intent of this disclosure.

Though the opening 136 to the receiving volume 135 is shown in FIG. 5 as being above the bottom 141 of the receptacle feature 140, where present, it should be understood that the opening 136 to the receiving volume 135 could be outside or otherwise entirely or at least partially away from the receptacle feature 140, such as where the receptacle feature 140 is distal to the opening 136 to the receiving volume 135 relative to the hood 130, the opening 136 to the receiving volume 135 could be above the receptacle feature 140, or the opening 136 to the receiving volume 135 could be even with or below the bottom 141 or another surface of the receptacle feature 140.

Though not depicted in the embodiments shown, the receiving volume 135 may optionally include an access feature, such as an opening with a removable plug or cover, to aid in cleaning the receiving volume 135, providing access for cleaning tools or providing drainage as needed.

Figure 6:
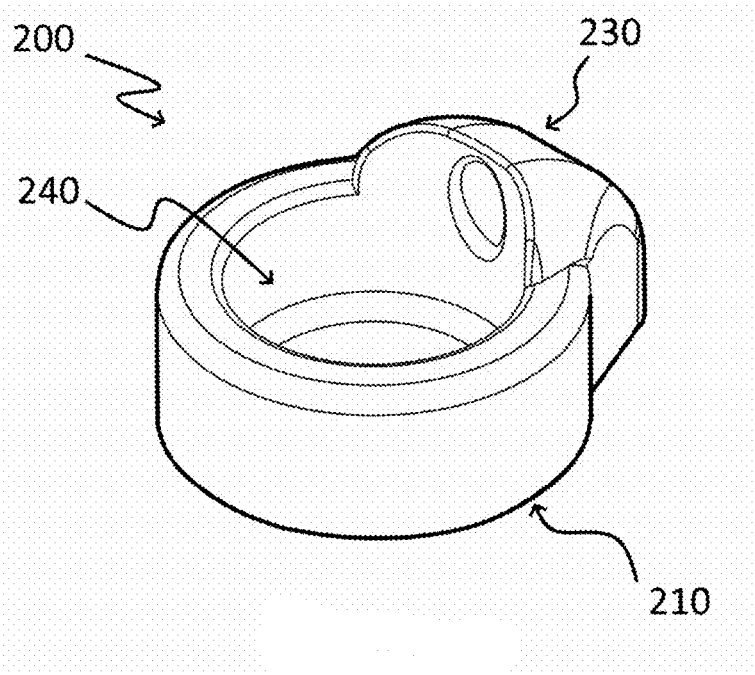
FIG. 6 shows a front top right isometric view of an alternate embodiment of the extinguishing device of the present disclosure.
Figure 7:
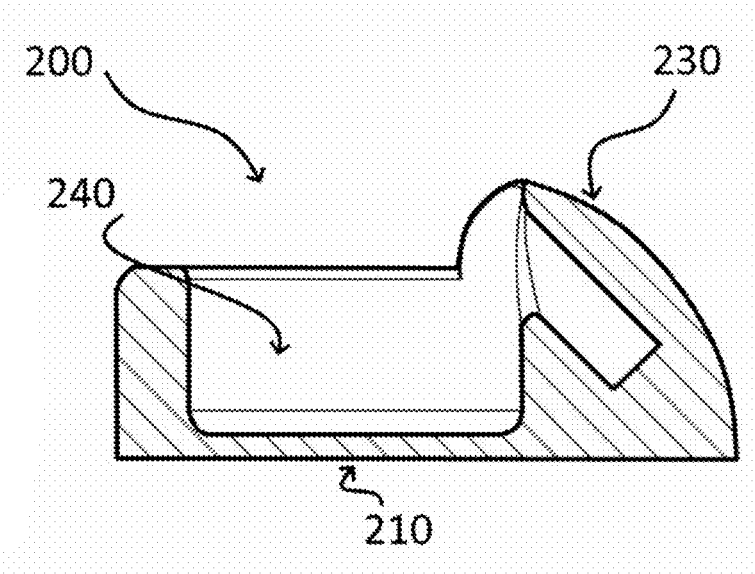
FIG. 7 shows a right side cross-sectional view of the embodiment of the extinguishing device of FIG. 6.

Another embodiment of the device 200 is shown in FIGS. 6-7. In the embodiment shown, the device 200 has a base 210 with a footprint that is substantially circular. The hood 230 may extend away from the base 210, such that the hood 230 may be at least partially not part of the footprint of the base 210. Though the embodiments shown depict the hood 230 extending upwards directly from at least a portion of the base 210, it should be understood that alternate embodiments of the device 200 might include a hood 230 which is optionally a separate component from the base 210, such as where the hood 210 is a removable component or can be opened or closed independently or in unison with the receptacle feature 240, or where the hood 230 may be at least partially offset from the base 210 and above the base 210, and not comprise the footprint of the base 210, such as where the hood 230 may be elevated above the base 210.

Figure 8:
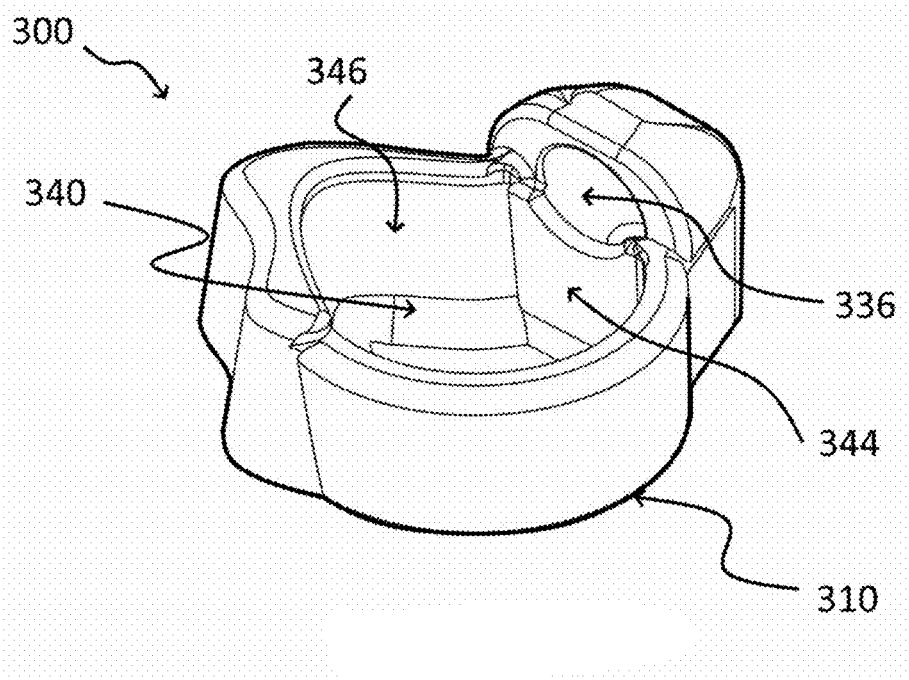
FIG. 8 shows a front right top isometric view of another embodiment of the extinguishing device of the present disclosure.
Figure 9:
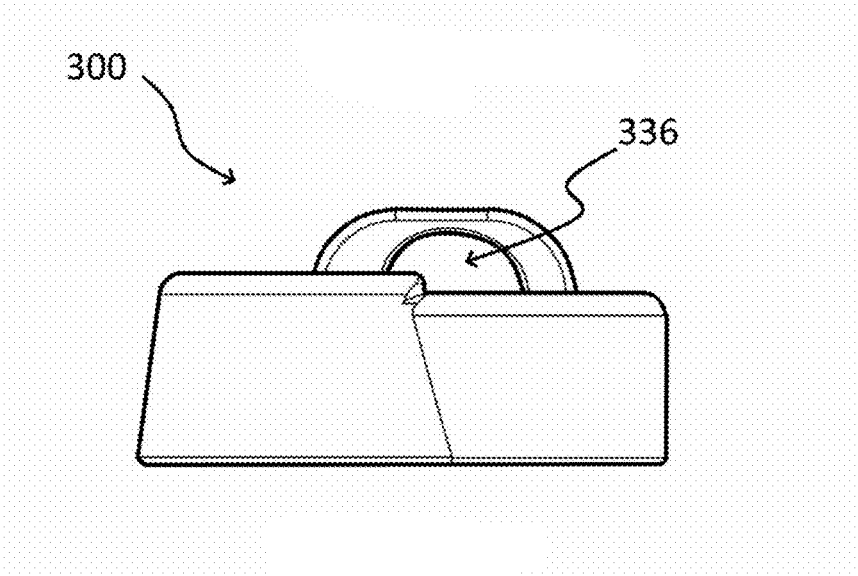
FIG. 9 shows a front view of the embodiment of the extinguishing device of FIG. 8.
Figure 10:
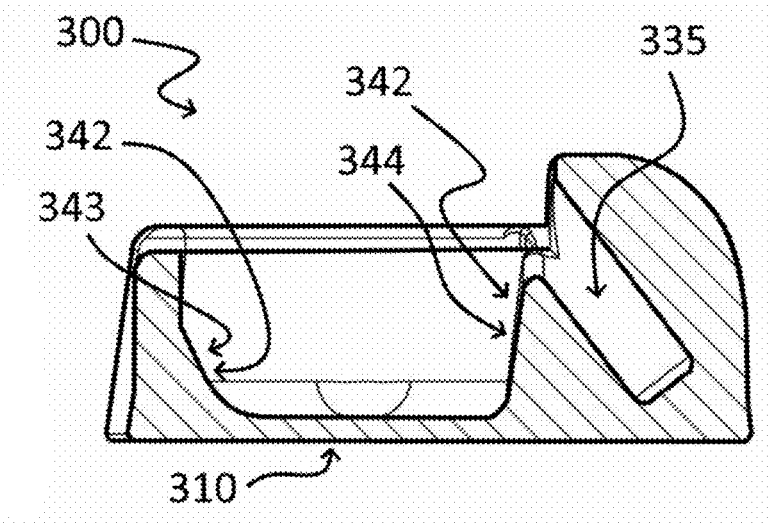
FIG. 10 shows a right side cross-sectional view of the embodiment of the extinguishing device of FIG. 8.

As shown in FIGS. 8-10, the device 300 may be a compound shape or may otherwise be irregular, or may be shaped so that it creates an artistic, creative, or fanciful impression for a user, such as when viewing the device 300 from above or in regards to the base 310 of the device 300.

The opening 336 of the receiving volume 335 may also be offset from the middle of the device, such as when viewed relative to a front view of the device 300 as seen in FIG. 9, and, as shown, the opening 336 or a portion or all of the receiving volume 335 may optionally not be circular, but may be, as shown by way of example in FIG. 9, elliptical. Where a receptacle feature 340 may optionally be present, the receptacle sides 342 may not be consistent or identical throughout, such as where, by way of example, as front receptacle side wall 343 may be angled or shaped differently than a rear receptacle sidewall 344. The same may apply to side receptacle sidewalls 346.

Figure 11:
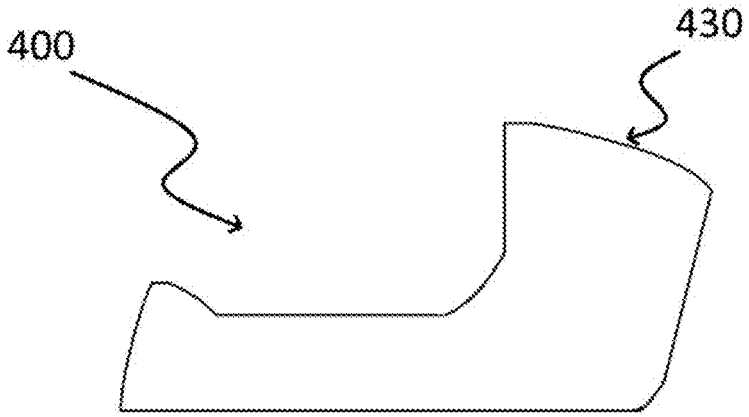
FIG. 11 shows a right side view of an alternate embodiment of the extinguishing device of the present disclosure.
Figure 12:
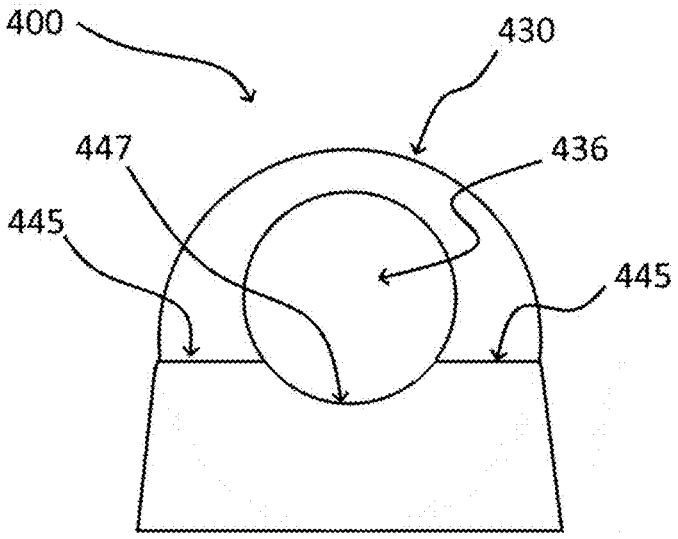
FIG. 12 shows a front view of the embodiment of the extinguishing device of FIG. 11.
Figure 13:
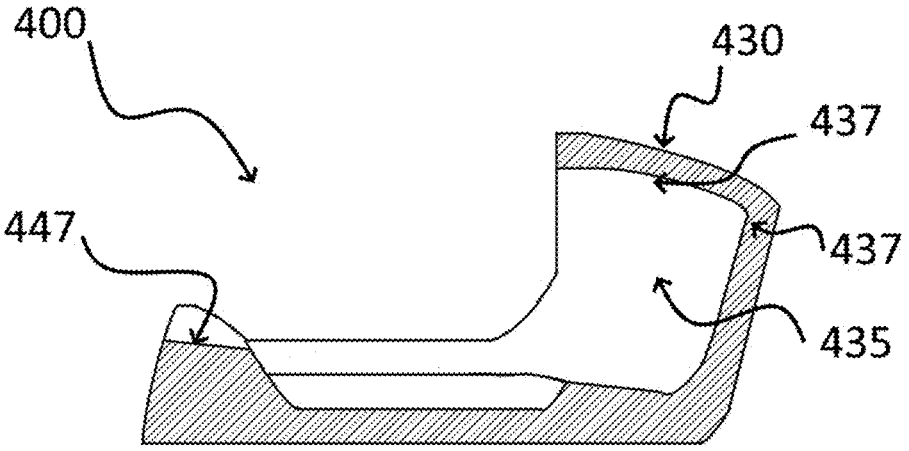
FIG. 13 shows a right side cross-sectional view of the embodiment of the extinguishing device of FIG. 11.

In some embodiments, such as the one shown in FIGS. 11-13, the device 400 may include a hood 430 with a receiving volume 435 that more closely mimics the shape of the hood 430, though optionally offset relative to one or more sides of the hood 430. Though the opening 436 and the receiving volume 435 are shown as substantially circular when viewed from the front of the embodiment shown, such as in FIG. 12, it should be understood that the opening 436, the receiving volume 435, or both may optionally not be circular, such as where the hood 430 might optionally be a thinner wall section and the opening 436 matches the profile of the hood 430, though offset by the wall thickness.

The device 400 may optionally include an indent or retention feature 447, configured to aid in retention of a cigar or cigarette, such as when one might be rests on or at least partially within the device 400, or if the cigar or cigarette is placed partially within the receiving volume 435. In the embodiment shown, the retention feature 447 is shown as an indent in an optional rim 445, such as one surrounding the receptacle feature 440. It should be understood, however, that the optional retention feature 447 may be located elsewhere on the device 400 without deviating from the scope or intent of this disclosure.

As shown, the retention feature 447 partially matches to contour and profile of the receiving volume 435, and is shown as optionally co-planar with the receiving volume 435 when viewed from a side cross-section, allowing a user to rest a cigar or cigarette on the retention feature 447 while a portion of that cigar or cigarette is optionally inserted into the receiving volume 435. It should be understood, however, that the retention feature 447 may partially or entirely not align with a portion or all of the receiving volume 436 without deviating from the scope or intent of this disclosure.

In the embodiment shown in FIGS. 11-13 includes an optional pocket or capture volume 437 within the receiving volume. This pocket 437 may be optionally configured to retain smoke when a cigar or cigarette is initially placed at least partially within the receiving volume 435, aiding in displacing oxygen and extinguishing the cigar or cigarette, such as when the angle of the receiving volume 435 or the sizing of the receiving volume 435 relative to a given used cigar or cigarette might not lead to satisfactory extinguishing of the cigar or cigarette otherwise.

Figure 14:
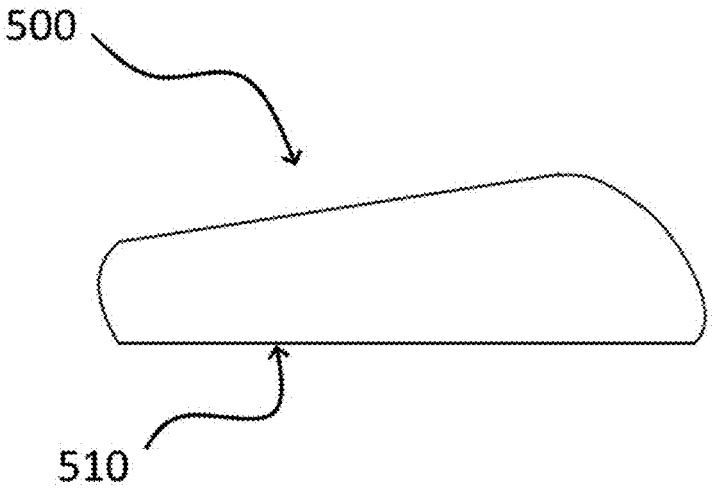
FIG. 14 shows a right side view of another embodiment of the extinguishing device of the present disclosure.
Figure 15:
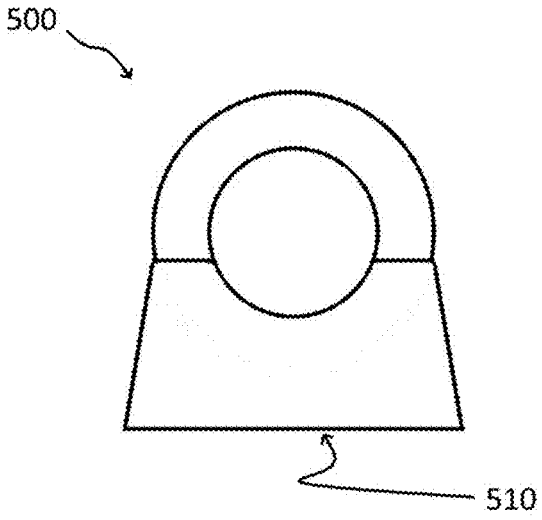
FIG. 15 shows a front view of the embodiment of the extinguishing device of FIG. 14.
Figure 16:
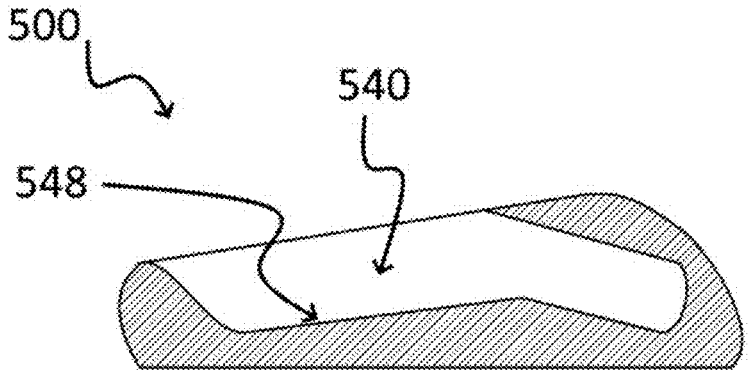
FIG. 16 shows a right side cross-sectional view of the embodiment of the extinguishing device of FIG. 14.

An alternate embodiment of the device 500 is shown in FIGS. 14-16. In the embodiment shown, the floor 548 of the receptacle feature 540 is shown as not being parallel with the base 510. It should be understood that the floor 548 of the receptacle feature 540, as well as the receptacle feature 540 itself, may be any shape, including various angles and curvatures, without deviating from the scope or intent of this disclosure. The receptacle feature 540, where present, may be an concave feature, an elongated channel, a sloping feature, or other shapes, curvatures, or angles, including compound shapes and hybrid shapes, without deviating from the scope or intent of this disclosure.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention. Accordingly, various modifications, adaptations, combinations, and alternatives may occur to one skilled in the art without departing from the spirit of the invention and scope of the claimed coverage.

What is claimed is:

1. An extinguishing device, comprising:

a base, further comprising a bottom side, and at least one elevated side;

a hood feature, further comprising a top side;

a receiving volume comprising a first at least partial opening; and a receptacle feature comprising a floor and distinct and separate from the receiving volume;

wherein the hood feature defines the first at least partial opening, and further wherein the first at least partial opening is configured to at last partially receive a smokable item, and further wherein the receiving chamber is an at least partially open volume within the hood feature, the receptacle feature is configured to receive byproducts of the smokable item, and the floor is at least partially below the first at least partial opening relative to the top side.

2. The extinguishing device according to claim 1, further wherein the first at least partial opening is configured to minimize oxygen remaining surrounding a portion of a smokable item once that portion is inserted at least partially into the first at least partial opening.

3. The extinguishing device according to claim 1, further wherein the receiving chamber is configured to displace oxygen with smoke emanating from the smokable item when the smokable item is at least partially lit.

4. The extinguishing device according to claim 3, further wherein the receiving volume extends downward from the first at least partial opening relative to the top side.

5. The extinguishing device according to claim 3, further wherein the receiving volume extends substantially parallel to the bottom side from the first at least partial opening and relative to the top side.

6. The extinguishing device according to claim 3, further wherein the floor is substantially planar.

7. The extinguishing device according to claim 3, further wherein the floor is at least partially concave.

8. The extinguishing device according to claim 3, further comprising a rim at least partially surrounding the receptacle feature.

9. The extinguishing device according to claim 8, further comprising an indent on the rim configured to aid in retention of a smokable item.

10. The extinguishing device according to claim 3, further comprising a retention feature configured to aid in retention of a smokable item.

11. The extinguishing device according to claim 3, further wherein the first at least partial opening is at least partially above all of the floor relative to the top side.

12. A method of using an extinguishing device, comprising:

lighting at least a first lightable portion of a smokable item;

placing at least a portion of the smokable item at least partially within a first opening of the extinguishing device;

wherein the extinguishing device comprises a base, a bottom side, at least one elevated side, a hood feature, a top side, and a first at least partial opening, and further wherein the hood feature defines the first at least partial opening of the extinguishing device, and further wherein the first at least partial opening of the extinguishing device is configured to at last partially receive a smokable item and further wherein the extinguishing device comprises a smokable item receiving volume which comprises the first opening of the extinguishing device, the extinguishing device further comprises an ash receiving volume which is separate and distinct from the smokable item receiving volume, and the ash receiving volume comprises a floor, and the floor is at least partially below the first opening of the extinguishing device relative to the base.

13. The method of using an extinguishing device according to claim 12, further comprising the step of removing the at least a portion of a smokable item from the first opening once the smokable item has been exinguished.

14. The method of using an extinguishing device according to claim 13, further comprising the step of placing the smokable item on a rim of the extinguishing device.

15. The method of using an extinguishing device according to claim 14, further wherein the smokable item is placed at least partially within an indent defined by the rim of the extinguishing device.

16. The method of using an extinguishing device according to claim 13, further comprising the step of depositing ash from the smokable item in the ash receiving volume.

17. The extinguishing device according to claim 3, further wherein the floor extends away from the first at least partial opening downwards and towards the bottom side relative to the top side.

18. An extinguishing device, comprising: a base, further comprising a bottom side, and at least one elevated side; a hood feature, further comprising a top side; and a receiving volume comprising a first at least partial opening; and a receptacle feature comprising a floor and distinct and separate from the receiving volume; wherein the hood feature defines the first at least partial opening, and further wherein the first at least partial opening is configured to at last partially receive a smokable item, and further wherein the receiving chamber is an at least partially open volume within the hood feature, the receptacle feature is configured to receive byproducts of the smokable item, and the floor is at least partially below the first at least partial opening relative to the top side, and wherein the receiving chamber, is configured to displace oxygen with smoke emanating from the smokable item when the smokable item is at least partially lit, and wherein the first partially open volume within the hood feature is substantially even with the floor relative to the top side.

* * * * *